United States Patent [19]

Sjöberg

[11] Patent Number: 5,062,343

[45] Date of Patent: Nov. 5, 1991

[54] METHOD AND A DEVICE FOR FILLING A SPACE IN AN AMMUNITION UNIT WITH EXPLOSIVE

[75] Inventor: Per Sjöberg, Karlskoga, Sweden

[73] Assignee: Nobel Kemi AB, Karlskoga, Sweden

[21] Appl. No.: 529,458

[22] Filed: May 29, 1990

[30] Foreign Application Priority Data

May 29, 1989 [SE] Sweden ..... 8901900

[51] Int. Cl.[5] ..... F42B 4/00

[52] U.S. Cl. ..... 86/20.1; 86/20.14; 86/31; 86/20.12

[58] Field of Search ..... 86/20.14, 21, 31, 33, 86/20.12, 25, 20.1

[56] References Cited

U.S. PATENT DOCUMENTS 1,689,778 10/1928 Hansen ..... 86/31
2,364,415 12/1944 Arnold et al. ..... 86/20.14
3,047,034 7/1962 Sassmannshausen et al. ..... 86/20.14
3,766,820 10/1973 Forsten et al. ..... 86/23

*Primary Examiner*—Deborah L. Klye
*Assistant Examiner*—J. Woodrow Eldred
*Attorney, Agent, or Firm*—Pollock, Vande Sande & Priddy

[57] ABSTRACT

The present invention comprises a method and apparatus for filling a space in at least one ammunition unit with a ready-mixed explosive containing a substance which imparts high viscosity to the explosive. The method comprises supplying the explosive into a flexible container with a single opening therein, positioning the flexible container into a second container adapted to withstand high internal pressure, applying a high pressure into the second container thereby exposing the flexible container to the high pressure, and pressing out the explosive from the flexible container through the opening in the flexible containers into the space in the ammunition unit upon application of the high pressure whereby filling the space with the explosive.

12 Claims, 1 Drawing Sheet

METHOD AND A DEVICE FOR FILLING A SPACE IN AN AMMUNITION UNIT WITH EXPLOSIVE

TECHNICAL FIELD

The present invention relates to a method of filling a space in an ammunition unit, for example a shell, with ready-mixed explosive containing plastic, such as polymer that imparts high viscosity to the explosive substance. The invention also relates to a device for implementation of the method.

BACKGROUND ART

In the manufacture of explosives and application thereof into ammunition units/shells it is known in the prior art to utilize an ongoing production where explosive is mixed in the mixer and the ready-mixed substance is filled/cast in the ammunition units in question. The mixing of explosive is then carried out in a first premises while the filling is carried out in a second premises.

In handling of explosives containing polymer, such as monomer plus hardener, problems are encountered in performing the continuously ongoing manufacturing. This type of explosive, so-called PBX explosive, has viscosity which is too high to permit gravitation casting. Special measures must therefore be taken to force the explosive down into the space in the ammunition unit through some type of extruding operation. The mixer, however, does not give any extrusion pressure and instead use must be made of some type of equipment where such extruding pressure can be obtained. An extrusion with the aid of screws is not acceptable from the standpoint of safety. The problem is aggravated by the fact in that casting and mixing are not usually performed in the same premises, which means that the continuously mixed compound must be capable of being transported before it is cast.

SUMMARY OF THE INVENTION

The object of the present invention is to provide a method and a device which solve, among other things, the problems outlined above. According to characteristic features of the new method the ready-mixed explosive is applied in a sacklike pouch which, on filling of the explosive into the space in the ammunition unit/-shell, is exposed to external pressure which causes the explosive to be pressed into the space in the ammunition unit via an aperture in the pouch and completely fill out the space.

In the preferred embodiment of the method the sacklike pouch shall be applied in a stout steel container, in which the pouch can be exposed to the high external pressure. Prior to application of the high pressure the interior of the pouch is placed under vacuum for removal of the air. In the preferred embodiment the ammunition unit, at least its space which is to be filled with explosive, is also placed under vacuum, which guarantees a practicable filling out of the space.

The container is utilized preferably as a transport device from one premises to another. The pouch is secured in the container at an inner surface thereon. The container is thus provided with an aperture, through which the explosive from the pouch is pressed out. After filling of the number of ammunition units corresponding to the contents of the sacklike pouch it can be turned with its inside surface out and cleaned to allow reuse of the equipment.

A device for implementation of the new method includes a sacklike pouch adapted to contain the explosive and provided with an aperture through which the explosive is pressed out into the space in the ammunition unit when the pouch is exposed to a high external pressure. The casing is preferably disposed in a stout container which withstands high internal pressures and such that the external pressure on the sacklike pouch is applied within the container. The pouch is preferably made of plastic, leather or a similar material giving low friction against the explosive when this is pressed out of the pouch.

Numerous advantages are obtained by that the apparatus and method of the invention. The friction is virtually non-existent despite the compound/explosive being extruded. The filling procedure of the ready-mixed explosive in the filling equipment is very simple. The new method and the new device imply that the mixer can be run continuously. In this case a plurality of devices according to the invention are utilized and circulate in the production. If the compound/explosive is polymerized prematurely and thus does not become castable, only the explosive in the affected sacklike pouch is lost and no other production disruptions occur. In addition the method is extremely inexpensive.

A currently proposed embodiment of the new method and device according to the present invention will be more readily understood from the following brief description of the accompanying drawing, and discussion relating thereto. In the accompanying drawing,

DESCRIPTION OF PREFERRED EMBODIMENT

Figure 1:
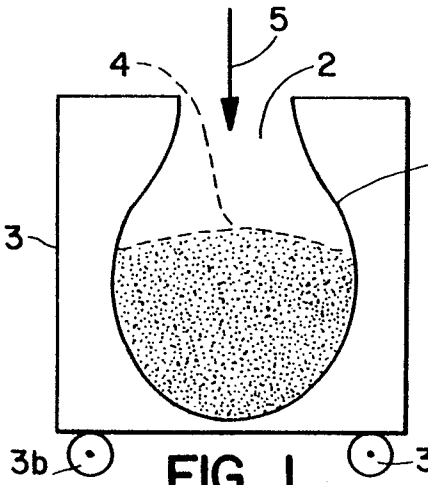
FIGS. 1-5 illustrate different functional stages for transfer of explosive from rolling mill to filling/casting in the ammunition unit and cleaning of the equipment.

Shown in FIG. 1 and designated with reference numeral 1 is a sacklike pouch made of, for example, plastic or leather. The pouch is provided with an aperture 2. The pouch is further applied into a steel cylinder 3. Compound consisting for example of octogen or hexogen with polymers, such as monomers and hardeners, is applied into the sacklike pouch 1 through the aperture 2 in the direction of the arrow 5. The PBX explosive is ready-mixed in a known manner in a mixer.

Figure 2:
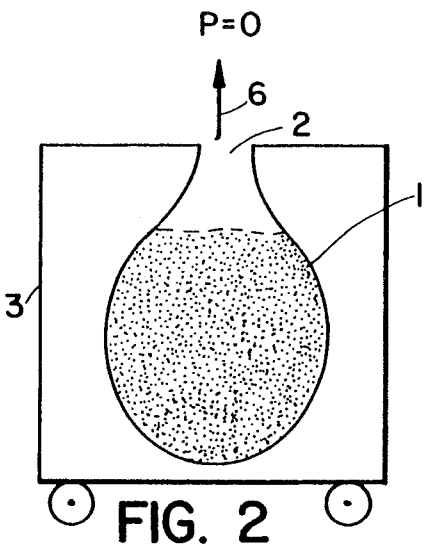

After filling of the pouch the with the ready-mixed explosive contents of the pouch are subjected to vacuum in accordance with FIG. 2, the pressure P then being, in the ideal case, roughly equal to 0. The application of vacuum can take place in a known manner. The vacuumizing is illustrated with the aid of arrow 6 and causes the air to be sucked out of the compound.

Figure 3:
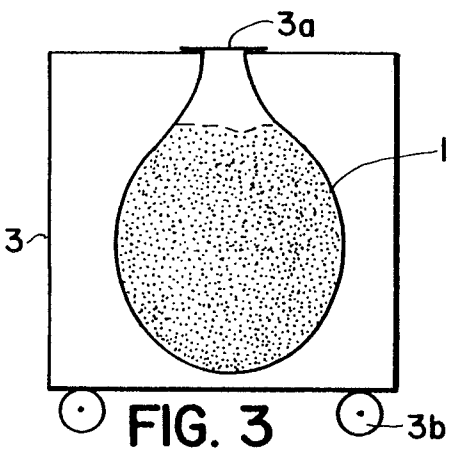

In accordance with FIG. 3 the steel container is provided with closure 3*a* which after the air has been sucked out of the explosive in the pouch is closed. The steel container is preferably provided with wheels in order to be utilized as a transport device from the mixing location to a location where filling of the ammunition unit in question is to take place. The wheels on the container are designated as 3*b*.

Figure 4:
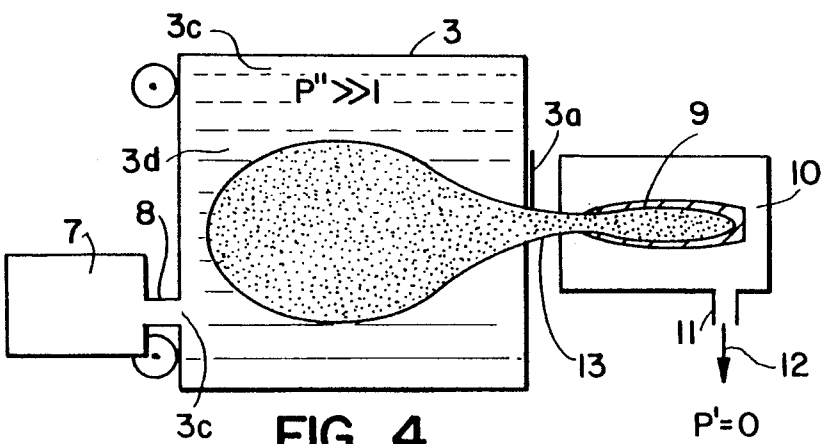

In the premises for casting the interior space of the container is connected as shown in FIG. 4 to a pressure source 7, for example a compressed air source. The connection takes place via a connection 8 and an aperture 3c in the steel container 3. A space in the ammunition unit or ammunition unit/shell 9 is on filling/casting disposed in a space 10 which is put under vacuum. The vacuum connection is designated 11 and the vacuum source consists of a known kind. The vacuumizing is symbolized with an arrow 12 and in the ideal case the pressure P' is approximately 0. The closure 3a on the container is opened and the interior space in the sacklike pouch is connected to the space in the ammunition unit in question which is to be filled with explosive through a connection 13. The actual filling procedure or extrusion takes place such that the pressure source 7 is connected to the internal space 3d in the container. The pressure source effectuates a pressure P'' which is much larger than 1. The sacklike pouch is thus squeezed together and its contents are transferred to the space in question in the ammunition unit/shell. The high pressure in the space 3d and the vacuumizing of the ammunition unit/shell 9 guarantee that the space in question will be completely filled out. In the illustrated embodiment the container 3 has been turned on its side during the described filling procedure.

Figure 5:
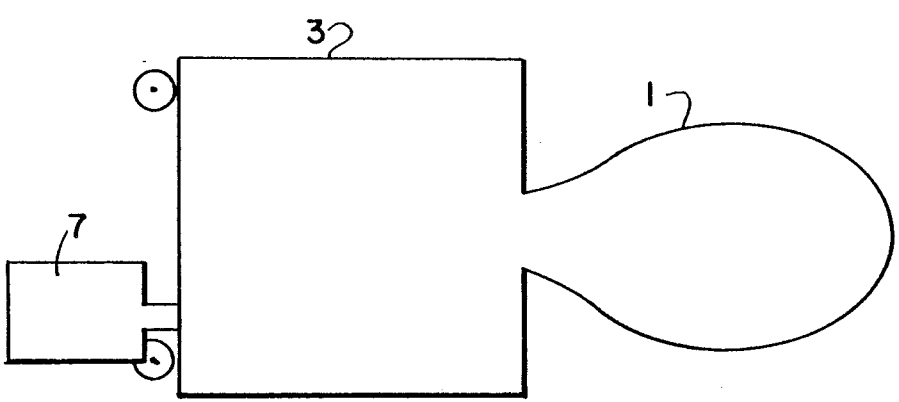

When the explosive contained in the pouch has been pressed out of the pouch into one or a plurality of ammunition units the casing can be cleaned in accordance with FIG. 5 to allow its reuse. The cleaning is made possible in that the pouch is turned with its inside surface outside the container 3, for example with the aid of the said pressurizing in the space 3c of the container with the aid of the pressure source 7. The pouch which has been turned inside out is cleaned with a suitable solvent, such as acetone, MEK.

The method for a continuous production of cast ammunition units includes the utilization of a number of containers 3 with associated pouches 1 which are recycled in the production.

The present invention should not be considered as restricted to the embodiment described above by way of example and shown on the drawing, many modifications being conceivable without departing from the spirit and scope of the appended claims.

What we claim and desire to secure by Letters Patent is:

1. A method of filling a space in at least one ammunition unit with a ready-mixed explosive containing a substance which imparts high viscosity to said explosive, said method comprising the steps of:

supplying said explosive into a flexible container having a single opening therein;

positioning said flexible container into a second container adapted to withstand high internal pressure;

applying a high pressure into said second container thereby exposing said flexible container to said high pressure;

pressing out said explosive from said flexible container through said opening in said flexible container into said space in said ammunition unit upon application of said high pressure whereby filling said space with said explosive.

2. A method according to claim 1, wherein said second container is made of steel.

3. A method according to claim 2, further including the step of subjecting said space in said ammunition unit to be filled with said explosive to vacuum prior to the beginning of said filling operation.

4. A method according to claim 1, further comprising the step of subjecting said explosive positioned in said flexible container to vacuum prior to the beginning of the filling operation.

5. A method according to claim 1, wherein said explosive includes polymer.

6. A method according to claim 1, wherein said flexible container is attached to an inner surface of said second container through a section supporting said opening, said second container at the point of attachment being provided with a corresponding aperture through which the explosive is pressed out, said flexible container being adapted, after completion of said filling procedure, to be turned with its inside surface out for cleaning in order to allow its reuse.

7. A device for filling a space in at least one ammunition unit with a ready-mixed explosive containing a substance which imparts high viscosity to the explosive, said device including a flexible container adapted to contain said explosive and provided with a single opening through which the explosive is pressed out into said space in the ammunition unit when said flexible container is exposed to a high external pressure.

8. The device according to claim 7, wherein said flexible container is disposed in a second container adapted to withstand high internal pressure, and wherein said external pressure is applied inside said second container.

9. The device according to claim 7, wherein said flexible container is made of a material which provides low friction against said explosive when said explosive is being pressed out.

10. The device according to claim 7, wherein said flexible container filled with said explosive therein is subjected to vacuum and wherein at least the space in the ammunition unit which is to be filled with an explosive, is subjected to vacuum.

11. The device according to claim 9, wherein said flexible container is made of leather.

12. The device according to claim 9, wherein said flexible container is made of plastic.

* * * * *